US005790994A

United States Patent [19]

Leonard

[11] Patent Number: 5,790,994

[45] Date of Patent: Aug. 11, 1998

[54] PANEL SYSTEM ACCOMMODATING VARIOUS BED SIZES

[76] Inventor: Mary Leonard, 6319 Camino de la Costa, La Jolla, Calif. 92037

[21] Appl. No.: 707,598

[22] Filed: Sep. 5, 1996

[51] Int. Cl.[6] ..... A47C 19/04; A47D 7/00

[52] U.S. Cl. ..... 5/53.1; 5/285; 5/280; 5/183; 5/93.2

[58] Field of Search ..... 5/43.1, 53.1, 280, 5/285, 282.1, 2.1, 183, 186; 52/282.3, 282.1, 764, 762

[56] References Cited

U.S. PATENT DOCUMENTS

| | | | |
|---|---|---|---|
| 825,467 | 7/1906 | Keightley | 5/183 |
| 829,666 | 8/1906 | Perry | 5/183 |
| 2,667,241 | 1/1954 | Shannon | 52/762 |
| 2,677,832 | 5/1954 | Christensen | 5/285 |
| 3,194,361 | 7/1965 | Thurman | 52/764 |
| 3,272,582 | 9/1966 | Anderson | 52/280 |
| 3,729,881 | 5/1973 | Disko | 52/282.1 |
| 4,361,919 | 12/1982 | Hull | 5/93.2 |
| 4,450,597 | 5/1984 | Hull | 5/2.1 |
| 5,146,631 | 9/1992 | Deal | 5/183 |
| 5,173,974 | 12/1992 | Proano et al. . | |

FOREIGN PATENT DOCUMENTS

| | | | |
|---|---|---|---|
| 67365 | 11/1954 | France | 5/183 |
| 424461 | 8/1947 | Italy | 5/285 |
| 2137876 | 10/1984 | United Kingdom | 5/285 |

*Primary Examiner*—Flemming Saether
*Attorney, Agent, or Firm*—Fish & Richardson P.C.

[57] ABSTRACT

A modular expandable bedframe accessory system is provided. The system includes a plurality of panel members having different predetermined widths. A plurality of support columns are interchangeably coupleable to sides of the panels to form different panel assemblies having different predetermined configurations. The system preferably includes a back panel and a plurality of side panels so that panel assembly is expandable from a crib configuration, to a day bed configuration, and to a king size headboard configuration. The different bedframe accessory systems configured with the invented modular system can be constructed and dismantled without the use of tools.

14 Claims, 4 Drawing Sheets

PANEL SYSTEM ACCOMMODATING VARIOUS BED SIZES

FIELD OF THE INVENTION

This invention relates to convertible furniture, and more particularly, to a modular expandable bedframe accessory system.

BACKGROUND OF THE INVENTION

Convertible furniture is well known in the prior art. Well known beds that convert from one form to another include trundle beds, sofa beds, and day beds. There are also a number of infant's cribs in the prior art that convert from a conventional crib to another configuration, with some modification. It is also known in the prior art to configure an infant's play pen with some suitable conversion means, that would provide an appropriate sleeping location for the infant.

One well known modification of cribs, is to provide the crib with rails or balustrades that are detachable from the crib. With the balustrades detached from the crib, the child has an easily accessible bed, with a headboard and a footboard. There are also a number of child's beds in the prior art configured to receive a crib's mattress, for providing a bed that is proportionally dimensioned for a child.

There are also cribs in the prior art that are provided with various accessories, such as a changing table for example. Often accessories are convertible so that they may be used for other purposes as the child grows.

However, a disadvantage common to the known prior art, is that the basic structure of the crib remains essentially the same. Therefore, after about two to three years of use, once the crib is too small for the growing child, the crib is no longer used and the investment therein is lost. Another bed, typically the known "twin" size, has to be purchased for the child, requiring further expense by the buyer.

Over time, the twin bed may also become to small for the child, such as when the child becomes a youth, and the bed again has to be replaced with a larger bed, such as a "queen" or "king" size bed. Again, purchasing of the larger bed requires further expense, particularly the expense associated with purchasing an accompanying headboard and footboard for the bedframe, and the investment in the twin bed is lost.

There, therefore exists a need for an expandable bedframe accessory system that can accommodate a wide range of bedframe sizes.

OBJECTS OF THE INVENTION

It therefore is an object of the present invention to provide a modular expandable bedframe accessory system; is another object of the present invention to provide a modular expandable bedframe accessory system that can accommodate a wide range of bedframe sizes;

It is a further object of the present invention to provide an expandable bedframe accessory system that can be configured as a crib;

It is still another object of the present invention to provide an expandable bedframe accessory system that can be configured as a day bed;

It is yet a further object of the present invention to provide an expandable bedframe accessory system that can accommodate a wide range of bedframe sizes ranging from a crib size frame to a king size frame; and It is another object of the present invention to provide a modular expandable bedframe accessory system that can be constructed and dismantled without the use of tools.

SUMMARY OF THE INVENTION

These and other objects and advantages of the present invention are achieved by providing a modular expandable bedframe accessory system. The modular system of the present invention includes a plurality of panel members having different predetermined widths. A plurality of support columns are interchangeably coupleable to the plurality of panels, to form a number of differently configured bedframe accessory systems.

The various different configurations of the invention can be constructed and dismantled without the use of tools. In the preferred embodiment, the columns are provided with a plurality of apertures. The apertures are disposed in the columns at different predetermined positions, depending upon the desired use of the particular column. Extension plates are affixed to sides of the panels for coupling the panels to the columns. The plates are configured to extend into the apertures and may have hook portions for securing the plates to the columns, for coupling the panels to the columns.

In the preferred embodiment, the panels of the modular system of the present invention include a back panel and a plurality of side panels. A first preferred configuration of the invented modular system comprises side panels that are coupled to the back panel, with the side panels residing in a common plane and extending perpendicularly to the back panel. A balustrade is secured between distal sides of the side panels to form a crib. A standard crib size bedframe can then be attached to the crib formed with the modular system of the present invention using known hardware.

The invented modular expandable system can also be configured as a day bed. The day bed configuration is achieved by coupling a first pair of side panels to the back panel, with configured to hold the side panels and back panel in a common plane. A second pair of side panels are coupled to the first pair of side panels, with uniquely configured columns that cause the second pair of side panels to extend perpendicularly to the first pair. The back panel and side panels are appropriately dimensioned, so that the day bed constructed has suitable dimensions. An appropriate day bed bedframe, such as twin size, is secured to the modular accessory system with conventional means.

Additionally, the expandable modular bedframe accessory system can be configured as a king size headboard. In this embodiment, the modular system is constructed, by coupling the back panel and a pair of side panels in a common plane, using suitably configured columns. The panels are dimensioned to provide a headboard of sufficient length for a king size bed. A king size bedframe can then be affixed to the constructed headboard as is known in the art.

In the expandable modular bedframe accessory system of the present invention, the back panel and side panels may have different predetermined widths. For example, the panels may have greater or lesser widths, so that the system of the present invention may be used to construct a number of differently configured bedframe accessory systems. Further, the back panel of the preferred embodiment is dimensioned to provide a headboard for either a twin or full size bedframe. Optically, panels of the present invention may be configured with an upper edge of a curvilinear shape for aesthetic purposes. When the panels are provided with the curvilinear shape, the upper edge of each of the panels could be configured to form a continuous curvilinear shape that extends from panel to panel.

BRIEF DESCRIPTION OF THE DRAWINGS

The above and other features, organizations, advantages and objects of this invention will be fully understood from the following detailed description and the accompanying drawings. Each of the drawings contained herein are not considered to be accurate depictions of the embodiments of the invention, but are provided for illustrative purposes only and are to be interpreted in conjunction with the attached specification.

DETAILED DESCRIPTION OF THE INVENTION

The following description is provided to enable any person skilled in the art to make and use the invention, and sets forth the best modes presently contemplated by the inventor for carrying out this invention. Various modifications, however, will remain readily apparent to those skilled in these arts, since the generic principals of the present invention have been defined herein.

Figure 1:
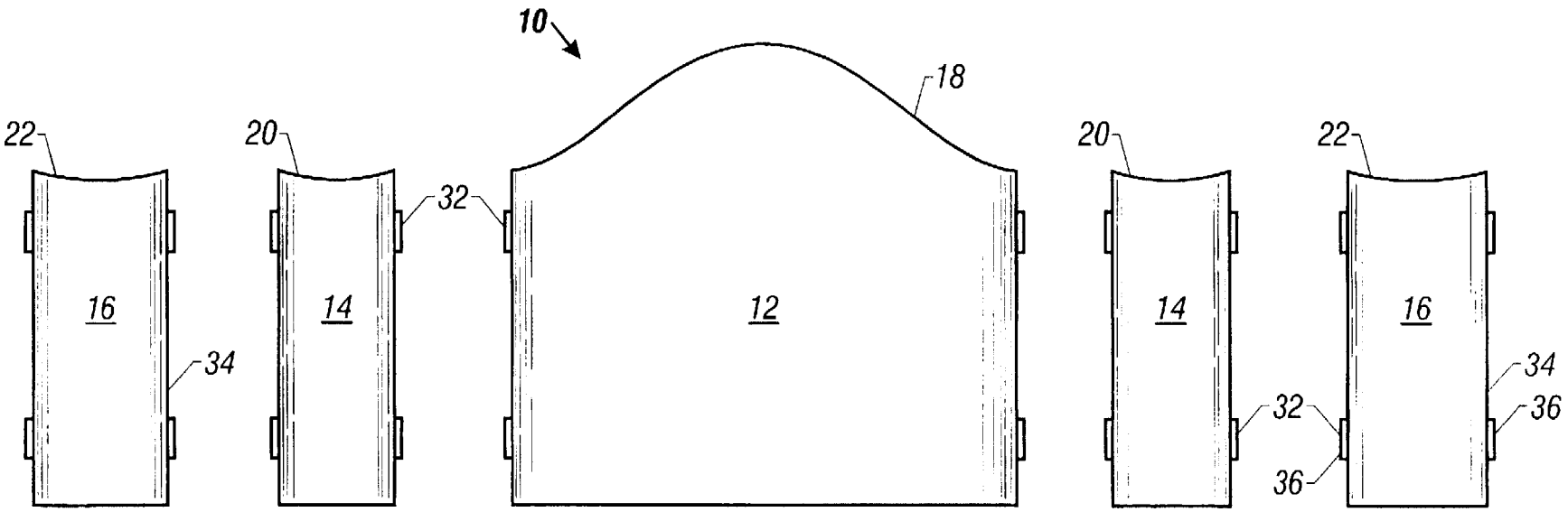
FIG. 1 is a plan view of a plurality of panels of a modular expandable bedframe accessory system of the preferred embodiment of the present invention.
Figure 2B:
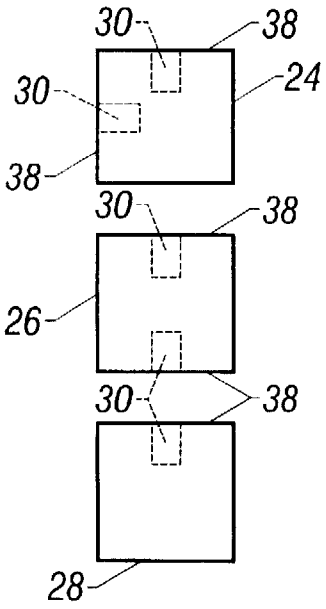
FIG. 2B is a top plan view of the support columns of FIG. 2A.
Figure 2A:
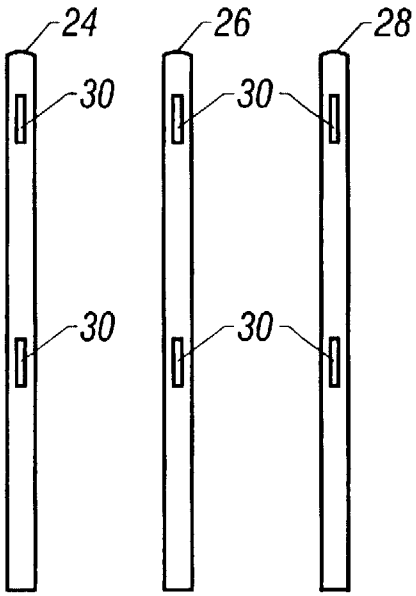
FIG. 2A is side view of three support columns of the modular bedframe accessory system of the preferred embodiment.

Referring now to FIG. 1 and FIGS. 2A and 2B of the drawings, there is shown, generally at 10, a preferred embodiment of a modular expandable bedframe accessory system, constructed according to the principles of the present invention. The present invention 10 provides a system for constructing, dismantling, and reconstructing a number of various differently configured bedframe accessory systems, ranging from an infant's crib to a king size headboard (discussed thoroughly hereafter), without the use of tools.

The modular system 10 of the present invention includes a plurality of panel members 12, 14, 16 having different predetermined widths. In the preferred embodiment, the panels of the modular system 10 include a wide back panel 12, a first pair of narrow side panels 14, and a second pair of somewhat wider side panels 16. The panels 12, 14, 16 may be fabricated from wood or other materials known in the art.

In the preferred embodiment of the invented system 10, the back panel 12 has an approximate width of 52 inches, the first pair of side panels 14 are approximately 13 inches wide, and the panels 16 of the second pair are approximately 16 inches wide. The panels 12, 14, 16 may be fabricated with greater or lesser widths, so that the present invention 10 may be configured as a bedframe accessory system for bedframes other than those disclosed particularly herein.

Additionally, each of the panels 12, 14, 16 of the present invention 10 may be configured with an upper edge 18, 20, 22 of a curvilinear shape for aesthetic purposes. When the panels 12, 14, 16 are provided with the curvilinear shape, the upper edges 18, 20, 22 are configured to form a continuous curvilinear edge that extends from panel to panel, when any of the panels 12, 14, 16 are coupled together.

A plurality of support columns 24, 26, 28 are provided for interchangeably coupling the panels 12, 14, 16 together for forming a number of differently configured bedframe accessory systems. Each of the columns 24, 26, 28 is preferably substantially rectangular and is provided with a plurality of spatially positioned apertures 30. The apertures 30 are configured to receive extension plates 32 affixed to sides 34 of the panels 12, 14, 16, for interchangeably coupling the panels 12, 14, 16 to the columns 24, 26, 28. The plates 32 may have downwardly depending hook portions 36 to prevent the plates 32 from inadvertently being withdrawn from the apertures 30.

The apertures 30 are disposed in the columns 24, 26, 28 at different predetermined positions, depending upon the desired use of the particular column. A first embodiment comprises a 90 degree column, wherein the apertures 30 are disposed in adjacent sides 38 thereof, so that there is a $\pi$degree angle formed between the apertures 30. This column 24 is used to connect and support adjacent panels 12, 14, 16 perpendicularly to one another.

A second embodiment of the columns 26 has apertures 30 disposed in opposing sides 38 thereof, for forming a $\lambda$degree angle between the apertures 30. The second column 26 couples adjacent panels 12, 14, 16 in a common plane.

A third embodiment of the columns 28 comprises an end column, wherein the apertures 30 are disposed in only one side 38 of the column 28. The end column 28 is affixed to the distal sides 34 of the outermost panel 12, 14, 16, for supporting the desired bedframe accessory constructed with the system 10.

Figure 3:
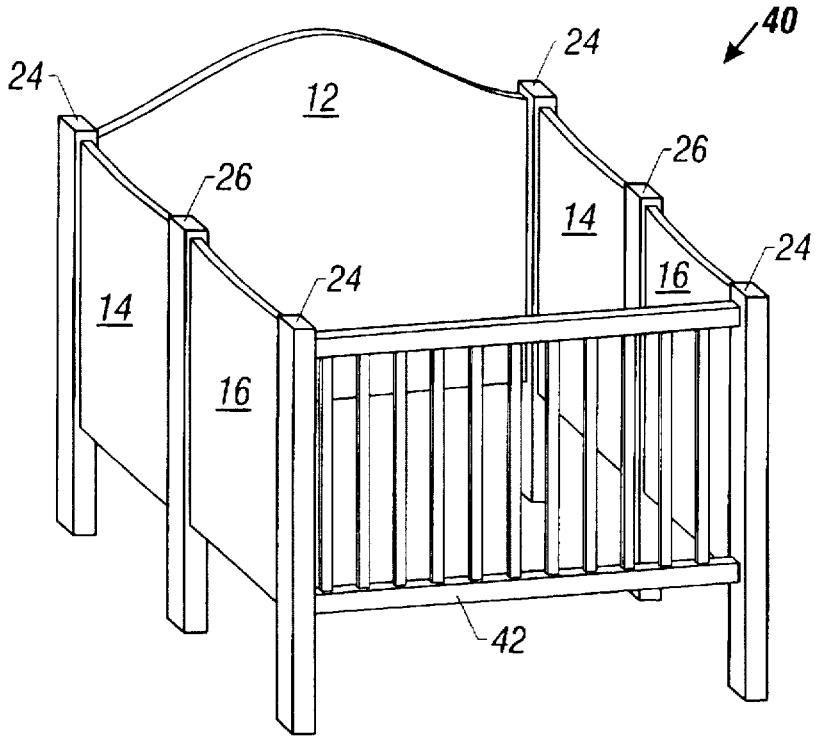
FIG. 3 is a perspective view of the expandable bedframe accessory system of the present invention configured as a crib.

Referring now to FIG. 3 of the drawings, there is shown a first preferred configuration of the invented modular system 10, wherein a crib 40 is constructed with the invented modular system 10. When the system is configured as a crib 40, the back panel 12 is connected to either the first or second pair of side panels 14, 16 with a pair of $\pi$degree columns 24.

The columns 24 are connected to the panels 12, 16 by disposing the plates 32 in the apertures 30 to positively coupled the desired panel 12, 14, 16 to the desired column 24, 26, 28. The remaining pair of side panels, the second pair 16 as shown in FIG. 3, is coupled to the first pair of panels 14 using 180 degree columns 26, so that the panels 14, 16 reside in a common plane that extends perpendicularly to the back panel 12.

A balustrade 42 is secured between distal sides of the side panels 16 with another pair of 90 degree columns 24, to form the crib 40. The second pair of columns 24 may include known hardware that enables the balustrade 42 to slide vertically along the columns 24, to provide a drop-side as is well known in the art. A standard crib size bedframe (not shown) can then be attached to the crib 40 using known hardware.

Figure 4:
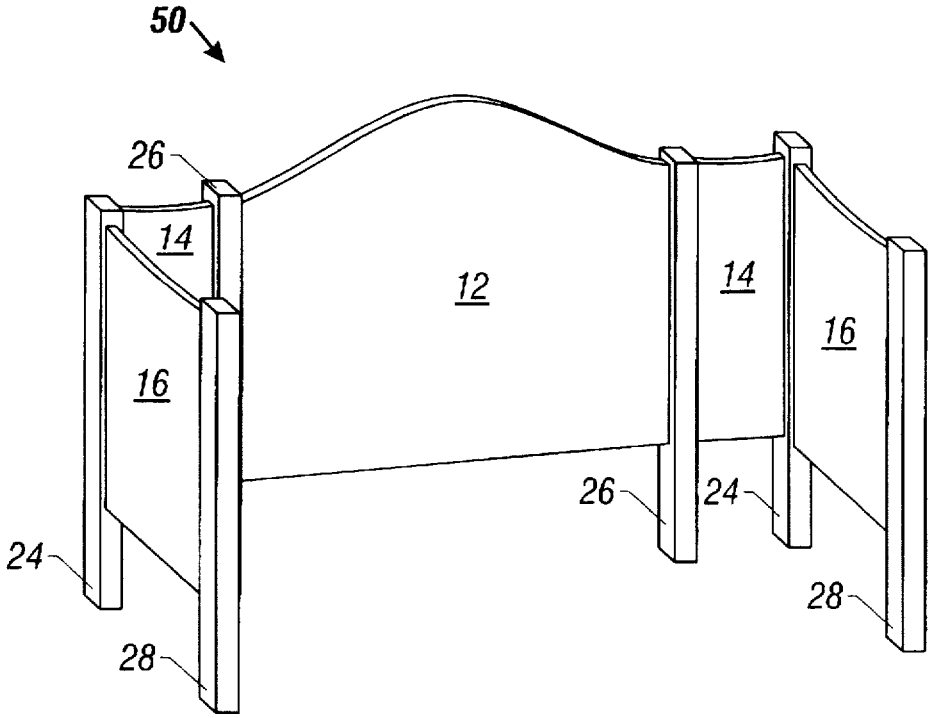
FIG.4 is a perspective view of a day bed constructed with the expandable modular system of the preferred embodiment.

Referring to FIG. 4 of the drawings, the invented modular expandable system 10 can also be used to construct a day bed 50. The day bed 50 is constructed by coupling the first pair of side panels 14 to the back panel 12, with a pair of 180 degree columns 26, as discussed above. The second pair of side panels 16 are coupled to the first pair 14, with a pair of 90 degree columns 24.

An end column 28 is secured to distal sides 34 of the side panels 16 to support the day bed 50. The back panel 12 and side panels 14, 16 are appropriately dimensioned, so that the bed 50 can accommodate known bedframe sizes, such as either twin or full sizes. The bedframe (not shown) is secured to the modular accessory system with conventional hardware.

Figure 5:
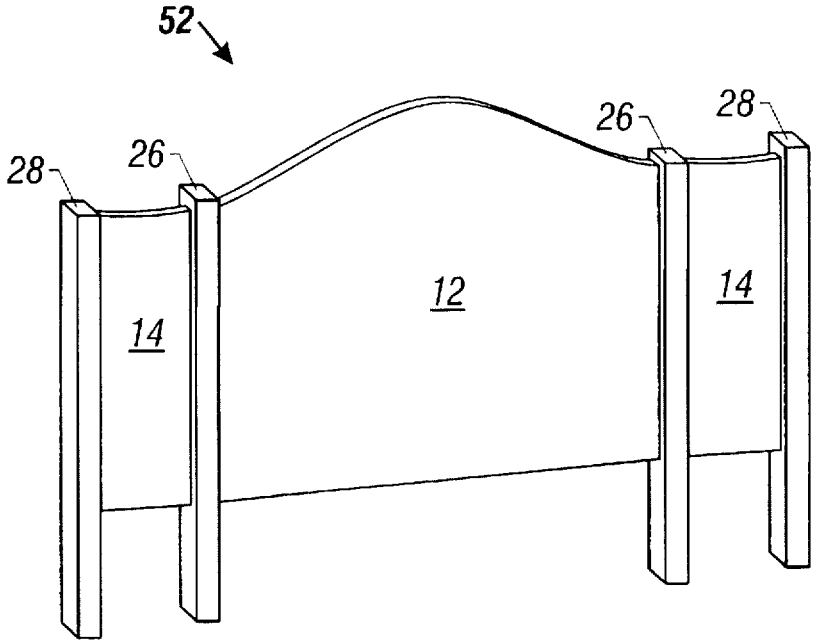
FIG. 5 is a perspective view of a king size headboard constructed with the invented modular system.

Referring now to FIG. 5 of the drawings, a king size headboard, shown generally at 52, can be constructed with the expandable modular bedframe accessory system 10 of the present invention. The headboard 52 is constructed, by coupling the back panel 12 and the first pair of side panels 14 with a pair of πdegree columns 26. A pair of end columns 28 are secured to ends 34 of the side panels 14 provide the headboard 52. A king size bedframe can then be affixed to the headboard 52 with hardware known in the art.

Figure 6:
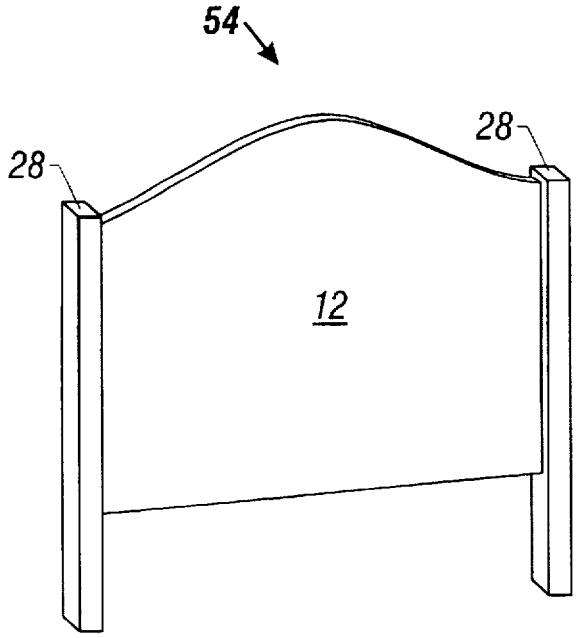
FIG. 6 is a perspective view of a full size headboard assembled with the modular expandable bedframe accessory system of the preferred embodiment of the present invention.

Referring to FIG. 6, the invented modular system 10 is shown constructed as a twin or full size headboard 54. The full size headboard 54 is configured, by supporting the back panel 12 at each end by an end column 28. An appropriate bedframe is then affixed to the headboard 54 with available hardware.

Thus, there has been described a modular expandable bedframe accessory system. The system of the present invention includes a plurality of panel members having different predetermined widths. The support columns are interchangeably coupleable to the panels to form various different bedframe accessory configurations. The numerous different configuration of the invented modular system are constructed and dismantled without the use of tools.

Those skilled in the art will appreciate that various adaptations and modifications of the just described preferred embodiments can be used and configured without departing from the scope and spirit of the invention. Therefore, it is to be understood that, within the scope of the appended claims, the invention may be practiced other than as specifically described herein.

What is claimed is:

1. A modular bed panel system comprising:

a plurality of panels; and a plurality of supports interchangeably coupleable to the panels to accommodate a desired bed size selectable from a plurality of bed sizes;

wherein the support are interchangeably coupled to at least two of said panels for retaining sides of the panels adjacent to each other to form a panel assembly, the supports coupled to the panels such that a support is interposed between adjacent sides of adjacent panels, and a support is coupled to distal sides of adjacent panels for supporting the panel assembly in the upright position such that the panels reside in a common plane.

2. The system of claim 1 wherein each of said panels has an upper edge of a curvilinear shape, the upper edge of the panels configured to form a continuous curvilinear shape that extends from panel to panel.

3. A modular bed panel system comprising:

a plurality of panels having different predetermined widths; and plurality of columns interchangeably coupleable to the panels, the plurality of columns interchangeably coupleable to predetermined ones of the plurality of panels for forming a panel assembly of a desired configuration which configuration accommodates a desired bed size and to support the panel assembly in an upright position wherein a first pair of columns are coupled to either side of a back panel and a first pair of side panels for retaining the side panels adjacent to the back panel, and a column coupled to each distal side of the side panels for supporting the panel assembly in the upright position such that the panel assembly resides in a common plane.

4. The system of claim 3 wherein the first pair of columns are configured to couple the first pair of side panels to the back panel, such that the panel assembly resides in said common plane for forming a headboard compatible with a king size bedframe.

5. The system of claim 4 wherein the first pair of columns are configured to couple the side panels to the back panel, such that the side panels reside in a common plane and extend perpendicularly to the back panel, and further comprising a balustrade extending between the distal sides of the second pair of side panels and interchangeably coupled thereto to form a crib.

6. The system of claim 4 wherein the back panel has a first width and the side panels have a width less than the back panel.

7. The system of claim 3 wherein each of said panels has an upper edge of a curvilinear shape, the upper edge of the panels configured to form a continuous curvilinear shape that extends from panel to panel.

8. A modular bed panel system comprising:

a plurality of panels having different predetermined widths, and including a back panel, a first pair of side panels, and second pair of side panels; and a plurality of columns interchangeably coupleable to the panels, the plurality of columns interchangeably coupleable to predetermined ones of the plurality of panels for forming a panel assembly of a desired configuration which configuration accommodates a desired bed size and to support the panel assembly in an upright position wherein a first pair of columns are coupled to either side of the back panel and the first pair of side panels for retaining the panels of the first pair of side panels adjacent to the back panel, and a column coupled to each distal side of the panels of the first pair of side panels for supporting the panel assembly in the upright position, the panels of the second pair of side panels coupled to the columns supporting the distal sides of the panels of first pair of side panels, and a second pair of columns coupled to each distal side of the panels of the second pair of side panels for supporting the panel assembly.

9. The system of claim 8 wherein the second pair of columns are configured to couple the second pair of side panels to the first pair of side panels, such that the second pair of side panels extend perpendicularly to the first pair of side panels to form a panel system compatible with a twin size bedframe.

10. A modular bed panel system comprising first through sixth panels configured so as to be selectively assembled into a plurality of configurations, wherein:

in a first such configuration, the second and third panels are coupled to the first panel at opposite sides of the first panel so that the first, second and third panels lie substantially coplanar in a first plane and are configured to form a headboard for a first standard size of bed; and in a second such configuration, the second and third panels are coupled to the first panel at opposite sides of the first panel so that the second and third panels are substantially perpendicular to the first panel, the second panel is coupled to and substantially coplanar with the fourth panel, the third panel is coupled to and substantially coplanar with the fifth panel and the sixth panel is coupled to the fourth and fifth panels so as to define a crib.

11. The system of claim 10 wherein:

in a third such configuration, the second and third panels are coupled to the first panel at opposite sides of the first panel so that the first, second and third panels lie substantially coplanar in a first plane, the second panel is coupled to and substantially perpendicular to the fourth panel, the third panel is coupled to and substantially perpendicular to the fifth panel and the sixth panel coupled to the fourth and fifth panels so as to define a day bed.

12. The system of claim 11 further comprising a plurality of columns and wherein the panels are coupled by the columns.

13. The system of claim 10 wherein the sixth panel is a balustrade.

14. The system of claim 10 wherein the first panel is sized so as to form a headboard for a second standard size of bed.

* * * * *